United States Patent [19]

Cotti

[11] Patent Number: 4,834,660

[45] Date of Patent: May 30, 1989

[54] FLEXIBLE ZERO INSERTION FORCE INTERCONNECTOR BETWEEN CIRCUIT BOARDS

[75] Inventor: Benedieto Cotti, St. Cloud, Fla.

[73] Assignee: Harris Corporation, Melbourne, Fla.

[21] Appl. No.: 57,558

[22] Filed: Jun. 3, 1987

[51] Int. Cl.[4] ..... H01R 9/09

[52] U.S. Cl. ..... 439/67; 439/65; 361/398

[58] Field of Search ..... 439/55, 59–62, 439/65–77, 85, 493, 496, 497; 361/398

[56] References Cited

U.S. PATENT DOCUMENTS

| | | | |
|---|---|---|---|
| 3,148,356 | 9/1964 | Hedden | 340/174 |
| 3,264,525 | 8/1966 | Swengel | 317/101 |
| 3,319,216 | 5/1967 | McCullough | 439/493 |
| 3,337,834 | 8/1967 | Godwin et al. | 439/497 |
| 3,401,369 | 9/1968 | Palmateer | 339/17 |
| 3,414,892 | 12/1968 | McCormack | 340/174 |
| 3,476,983 | 11/1969 | Roberts | 317/101 |
| 3,492,538 | 1/1970 | Fergusson | 361/398 |
| 3,505,570 | 4/1970 | Sprude | 317/101 |
| 3,609,463 | 9/1971 | Laboue | 317/101 DH |
| 3,665,370 | 5/1972 | Hartmann | 339/75 MP |
| 3,772,775 | 11/1973 | Bonnke et al. | 439/67 |
| 3,793,609 | 2/1974 | McIver | 339/74 R |
| 3,806,767 | 4/1974 | Lehrfeld | 317/101 CC |
| 3,818,414 | 6/1974 | Davies | 339/17 M |
| 3,858,958 | 1/1975 | Davies | 339/17 M |
| 3,950,057 | 4/1976 | Calabro | 339/65 |
| 3,951,493 | 4/1976 | Kozel | 339/17 M |
| 3,967,162 | 6/1976 | Caresa | 317/101 CM |
| 3,971,127 | 7/1976 | Giguere | 29/626 |
| 3,977,747 | 8/1976 | Broutros | 339/74 R |
| 4,054,742 | 10/1977 | Bonhomme | 174/68.5 |
| 4,157,612 | 6/1979 | Rainal | 439/493 |
| 4,196,955 | 4/1980 | Anhalt | 339/74 R |
| 4,203,203 | 5/1988 | Gilissen | 29/846 |
| 4,261,631 | 4/1981 | Guilcher | 339/75 MP |
| 4,303,294 | 12/1981 | Hamsher | 339/74 R |
| 4,399,488 | 8/1983 | Ruwe et al. | 361/398 |
| 4,421,370 | 12/1983 | Treakle | 339/59 M |
| 4,470,100 | 9/1984 | Rebaudo | 361/413 |
| 4,479,686 | 10/1984 | Hoshino | 339/17 LC |
| 4,502,098 | 2/1985 | Brown | 361/383 |
| 4,509,098 | 4/1985 | DasGupta et al. | 439/77 |
| 4,517,625 | 5/1985 | Frink | 361/399 |
| 4,528,530 | 7/1985 | Ketchen | 333/246 |
| 4,547,834 | 10/1985 | Dumont | 361/386 |
| 4,581,495 | 4/1986 | Geri | 179/179 |
| 4,587,596 | 5/1986 | Bunnell | 361/398 |

FOREIGN PATENT DOCUMENTS

| | | | |
|---|---|---|---|
| 1200409 | 9/1965 | Fed. Rep. of Germany | 439/328 |
| 700490 | 12/1953 | United Kingdom | 29/868 |

OTHER PUBLICATIONS

"Solving Problems with Elastomeric Connectors", by Ben Carlise, *Machine Design*, Nov. 24, 1983, pp. 87–91.

Rogers Solderlerss System, Rogers Corp., 1979.

Shin-Etsu's Advertisement, 1985.

Backplane Interconnection System, Gordon, pp. 565–585.

*Primary Examiner*—Neil Abrams

*Attorney, Agent, or Firm*—John L. DeAngelis, Jr.

[57] ABSTRACT

A zero-insertion force interconnect system. The interconnect system comprises at least two substantially parallel printed circuit boards on which electronic components are mounted. The printed circuit boards are held in place by a flexible U-shaped member running along one edge of each board. The U-shaped member includes a plurality of parallel electrical contacts, extending from either one of the printed circuit boards. The parallel electrical contacts are covered by insulator material with the exception of one small portion on each electrical contact. This exposed portion is mated with a mother board, which has a configuration of electrical contacts that matches the configuration of the U-shaped member. A resilient member is located behind the electrical contacts of the U-shaped member to provide wiping action between the contacts of the U-shaped member and the contacts of the mother board when the two units are brought together.

27 Claims, 13 Drawing Sheets

FLEXIBLE ZERO INSERTION FORCE INTERCONNECTOR BETWEEN CIRCUIT BOARDS

FIELD OF THE INVENTION

This invention relates to a zero insertion force interconnect system wherein the connector for connecting a daughter board to a mother board is an integral part of and is formed simultaneously with construction of the mother and daughter boards and etching of the circuit traces thereon.

BACKGROUND OF THE INVENTION

Electrical printed circuit boards (or printed wiring boards) with their mounted circuit components are well known and have long provided an advantageous technique for assembling electronic components in an orderly fashion and connecting these components together to form electronic circuits. The interconnections between these electronic components can be formed by printing or machine-depositing conductors on an insulating surface of the printed circuit board. Alternatively, the insulating surface is covered with a conductive material, the desired interconnection paths are masked, and the remaining unmasked portions of the conductive surface are etched away. The insulating layer of the printed circuit board is usually composed of phenolic-glass epoxy laminate, polyimide laminate, or ceramic. The conductive interconnecting material is usually copper.

With advances in the development of miniaturized and micro-electronic circuits for printed circuit boards, it has become necessary, and increasingly difficult, to develop interconnection techniques for accurately connecting adjacent circuit elements on a printed circuit board and interconnecting adjacent printed circuit boards. In the early 1960's the dual in-line package (DIP) became a popular package for integrated circuits. The DIP has a lead spacing of 100 mils. With increasing miniaturization and the desire to place more integrated circuits onto a circuit board, flat pack integrated circuit packages were developed and saw industry-wide use in the mid to late 1960's. Because lead spacing for flat pack packages is 50 mils, more flat pack packages than dual-in-line packages can be interconnected on a given printed circuit board. With the continued development of still smaller and more complicated integrated circuits, known as very high-speed integrated circuits (VHSIC), lead spacing has decreased to 20 mils.

As more components are mounted on a printed circuit board, it becomes necessary to provide more interconnection points between printed circuit boards of an electronic system. As is well known in the art, the typical technique for interconnecting boards is by providing a row of contacts or pins along one edge of each board such that each board (referred to as daughter board) may be plugged into a matching socket located on a mother board, establishing an interference contact. Interconnection wiring is provided between the pins on the daughter board and the daughter board electronic components, and between the socket on the mother board and the mother board electronic components. Both the contacts and sockets have to be built with care and accuracy to provide a reliable contact between the boards; the cost of providing these interconnections using the prior art methods can easily become a substantial part of the total system cost. Current interconnect requirements frequently require a connector to make 200 to 400 contacts with the contacts spaced apart by 30 to 50 mils. Using a pin-socket arrangement with this spacing, it is easy for one or more of the pins to become deflected and/or mate improperly in the socket, causing poor contact or no contact. Also, the insertion force, which is only two to four ounces per pin, aggregates to 50 to 100 pounds of insertion force in a high-pin count connector. Thus the problems caused by close connector spacing have become a dominant failure mode in electronic systems.

Alternatively, the interconnections between the mother and daugter board can be made in other ways. The connection can be made in a permanent manner using soldered or welded joints. While this provides a less costly initial assembly, it is difficult and expensive to later repair a system having permanent interconnections. Also, ribbon cables are frequently used to interconnect printed circuit boards. Each ribbon cable comprises a plurality of wires arranged side by side in a flat configuration. Each wire of the ribbon cables can be permanently soldered to a point on a printed circuit board, or connectors can be placed at one or both ends of the ribbon cable for insertion into a socket on the printed circuit boards.

Today, the principle technique for avoiding the prior art pin crunching connector mating device is to use connectors commonly referred to as the zero insertion force connectors. In this type of connector the pins and sockets are mated without any contact of the mating surfaces so that there is very little mating force. After the two halves have been mated, a latch or cam mechanism is operated to engage all of the contacts and complete the interconnection. Another advantage usually associated with zero-insertion force connectors is volume reduction over the prior art pin-socket arrangements. This feature is especially important in small-space environments, such as avionics packages for aircraft. These zero insertion force connectors have become very popular and many different types are available. Such a zero insertion force connector is disclosed and claimed in U.S. Pat. No. 4,517,625. This patent discloses and claims a circuit board with a plurality of electrical contacts mounted along an edge thereof. The housing into which the circuit board is placed has at least one zero insertion force socket including a plurality of contacts mounted therein. The circuit board is placed in the socket and a pair of jaws are moved to releasably engage the edge portion of the circuit board. With the motion of the jaws the electrical contacts of the circuit board are brought into contact with the electrical contacts on the housing.

By eliminating the pin-socket configuration, most zero insertion force connectors reduce the signal path length from the daughter board to the mother board, and also eliminate the possibility of discontinuities at the pin-socket connection. At the high frequencies associated with today's VHSIC and microwave technologies, these features reduce signal losses and delays. The present invention further improves upon these features.

SUMMARY OF THE INVENTION

The zero insertion force connector of the present invention is a novel departure from the prior art zero insertion force connectors. The present invention is an interconnect system, which takes into account the electrical transmission characteristics of the contact, rather than a simple zero insertion force connector. More specifically, the interconnect system of the present invention is integral with and fabricated at the same time as the traces on the printed circuit board. Thus the interconnect system eliminates the necessity for a separate connector as has been the common practice previously. The interconnect system comprises a rigiflex printed circuit board, an elastomer rod, and the well-known multi-layer glass epoxy printed circuit boards. Additional support members are also a part of the interconnect system.

In one embodiment, the daughter board portion of the interconnect system utilizes a rigid-flex printed circuit board having gold-plated contacts exposed in the flexible area. The flexible area is controlled by an elastomer rod and a retaining housing is also a part of the daughter board (or module). A gold-plated contact pattern is etched on the mother board (or back panel) and is backed by a structural member to provide rigidity. Gas-tight electrical contact between the contacts of the daughter board and the contacts of the mother board is achieved when screws are inserted through holes in the structural member and tightened.

The advantages of this novel interconnect system over the prior art connector designs are numerous. These advantages include cost and weight reduction and higher contact density, as well as better electrical performance. The present invention offers a higher number of contacts in a comparable space. That is, in one embodiment up to 420 contacts are available in a standard ¾ Avionics Transit Rack (ATR) enclosure, (which has a cross-section of 7.63 inches wide by 7.51 inches high). The solderless connections of the present invention also provide third level interconnections as an integral part of the printed board. (First level interconnections are within the integrated circuit chips; second level interconnects are between the electronic components and the printed circuit board; third level interconnects are between printed circuit boards, including a mother board (or back plane)-daughter board configuration.) Also, the direct and short electrical interface of this third level interconnect ensures better electrical performance.

BRIEF DESCRIPTION OF THE DRAWINGS

The present invention can be more easily understood, and the further advantages and uses thereof more readily apparent, when considered in view of the description of the preferred embodiments and the following figures in which.

DESCRIPTION OF THE PREFERRED EMBODIMENTS

Figure 1:
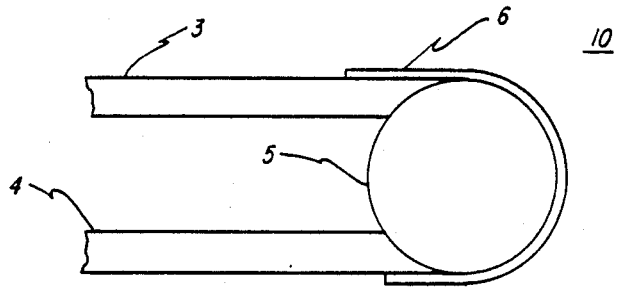
FIG. 1 is a partial illustration of the interconnect system of the present invention.

FIG. 1 is a simplified view of a zero insertion force interconnect system 10 of the present invention. The zero insertion force interconnect system 10 includes two substrates 3 and 4 adapted for mounting electrical components thereon. The substrates 3 and 4 are held in a spaced-apart relationship by a resilient rod 5. A plurality of conductive traces (one conductive trace is represented by reference character 6 in FIG. 1) extend between the substrates 3 and 4 and around the rod 5. When the substrates 3 and 4 are brought into contact with another planar member (not shown in FIG. 1), the conductive trace 6 mates with conductive traces on this other planar member so as to connect the components mounted on the substrates 3 and 4 with other electrical circuits. The remaining figures show more detailed embodiments of the present invention.

Figure 2:
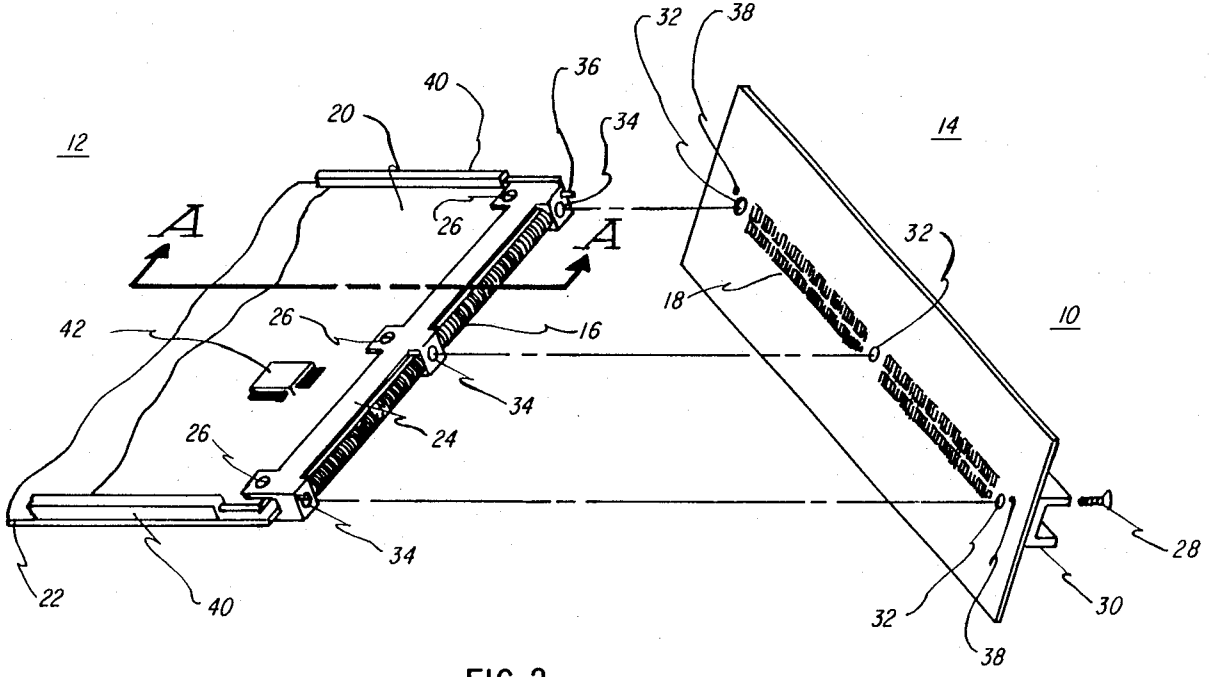
FIG. 2 is a perspective view of the interconnect system of the present invention.

FIG. 2 is a perspective view of the zero insertion force interconnect system 10 of the present invention. The zero insertion force interconnect system 10 includes a daughter board assembly 12 and a mother board 14. The daughter board assembly 12 includes a plurality of gold-plated contacts 16 arranged in a predetermined pattern, and the mother board 14 includes a plurality of gold-plated contacts 18 arranged in a pattern to align with the gold-plated contacts 16 of the daughter board assembly 12. In the embodiment illustrated in FIG. 1 there are 420 gold-plated contacts 16 and 420 gold-plated contacts 18; there are 210 gold-plated contacts in a top row and 210 in a bottom row, separated by an insulating space. The gold-plated contacts 16 and 18 are spaced at 0.025 inches (25 mils). The daughter board assembly 12 comprises two printed circuit boards; one of these printed circuit boards is designated by the reference character 20 and is shown in FIG. 2. The second printed circuit board (reference character 22) is parallel to and beneath the printed circuit board 20 and only the edge can be seen in the FIG. 2 perspective view. A heat sink, a conductive spacer or heat conductive plate can be placed between the printed circuit boards 20 and 22 if it is necessary to conduct heat away from the daughter board assembly 12. The heat sink is not shown in FIG. 2. Otherwise, a simple spacer is used between the two printed circuit boards 20 and 22 to obtain the required rigidity. The daughter board assembly 12 is fitted into a housing 24 for securing the daughter board assembly 12 to the mother board 14. The housing is detachably mounted to the daughter board assembly 12 using screws designated generally by reference character 26. In the FIG. 2 embodiment there are three screws 26. The housing 24 and the daughter board assembly 12 mount to the mother board 14 using screws 28. The screws 28 extend through an extruded backing member 30 and holes 32 in the mother board 14, and finally engage threaded holes 34 in the housing 24. The FIG. 2 embodiment shows three screws 28. Proper alignment between the daughter board assembly 12 and the mother board 14 is provided by alignment pins 36 that slideably engage in alignment holes 38 on the mother board 14. To provide additional support and thermal conduction, card retainers 40 are provided at each end of the mother board for engaging the daughter board. Card retainers of this type are well known in the art; see for example U.S. Pat. No. 3,676,747. FIG. 2 also shows an exemplary electronic component 42 mounted to the printed circuit board 20. Electronic components can also be mounted to the lower printed circuit board 22 in an upside-down fashion, assuming appropriate design of any spacer or conductive member between the printed circuit boards 20 and 22; these are hidden from view in FIG. 2. Traces on the printed circuit boards 20 and 22 connect the electronic components together, and where necessary these traces are extended from the printed circuit boards 20 and 22 and overlaid with gold to form the gold-plated contacts 16. When the daughter board assembly 12 is mounted to the mother board 14, as discussed above, the gold-plated contacts 16 and 18 mate and touch to connect the components on the printed circuit boards 20 and 22 to the mother board 14 and thus to other components of the electronic system. In another embodiment, components can also be mounted on either or both sides of the mother board 14.

Figure 3:
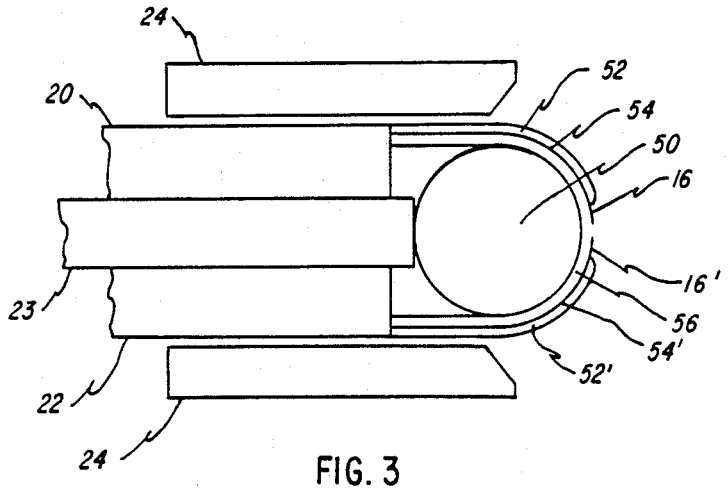
FIG. 3 is a more detailed view of the daughter board contacts shown in FIG. 1.

FIG. 3 is a close-up cross sectional view along line AA of FIG. 2. FIG. 3 also shows a spacer 23 and an elastomeric rod 50 that extends the length of the daughter board assembly 12. Extending from the printed circuit boards 20 and 22 are outer insulator layers 52 and 52', traces 54 and 54', and an inner insulator layer 56. The outer insulator layers 52 and 52' are removed, as shown, to expose a portion of the traces 54 and 54'. The traces 54 and 54' are copper traces etched in the printed circuit board and exposed in the area of the elastomeric rod 50. The traces 54 and 54' are gold plated for protection against corrosion and to enhance conductivity to form the gold-plated contacts 16 and 16'. As can be seen in this embodiment, the gold-plated contacts 16 and 16' are not continuous around the elastomeric rod 50, but instead form two separate contact points for mating with the mother board 14. As can be appreciated by those skilled in the art, the traces 54 and 54' are not required to terminate on the printed circuit boards 20 and 22, but may pass through to other adjacent circuit boards not shown in FIG. 3.

Figure 4:
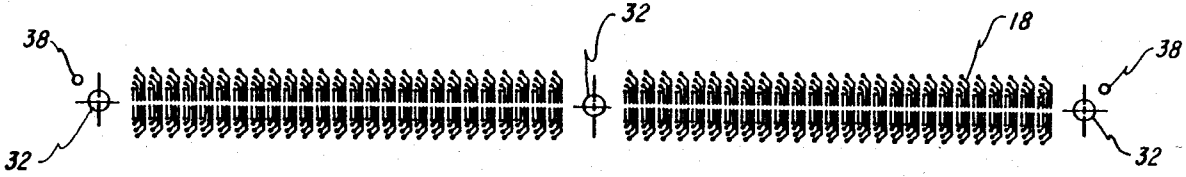
FIGS. 4 and 5 are more detailed views of the mother board contact pattern of FIG. 1.
Figure 5:
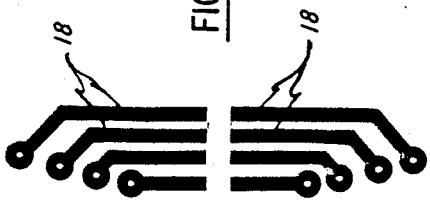

The gold-plated contacts 18 on the motherboard 14 must also have a split pattern to mate with the gold-plated contacts 16 and 16'. This pattern is shown generally in FIG. 4 and a few of the gold-plated contacts 18 are shown in a close-up fashion in FIG. 5. As can be seen clearly in FIG. 5, the gold-plated contacts 18 are split in half, with the top row mating with the top row of gold-plated contacts 16 and the bottom row of gold-plated contacts 18 mating with the lower row of gold-plated contacts 16'. The elastomeric rod 50 provides a slightly springy interaction between the daughter board assembly 12 and the mother board 14 to ensure contact between the gold-plated contacts 16 and 16' and the gold-plated contacts 18. To ensure good electrical contact it is also necessary that there be some wiping action between the gold-plated contacts 16 and 16' and the gold-plated contacts 18 during the initial mating. This wiping action is provided by the springy effect of the elastomeric rod 50 and the shape of edge of the housing 24.

Figure 6:
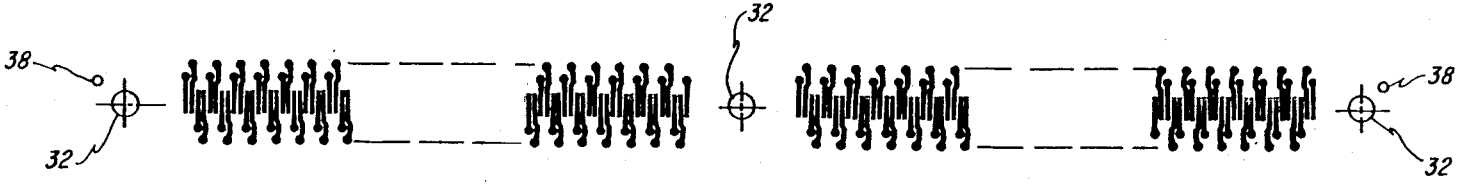
FIGS. 6 and 7 are detailed views of the mother board contact pattern for a second embodiment of the present invention.
Figure 7:
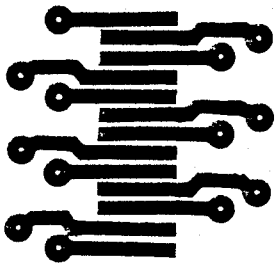

FIGS. 6 and 7 show another pattern for the gold-plated contacts 18 of the mother board 14. FIG. 7 is a sectional close-up of several of the gold-plated contacts 18 of FIG. 6. In this embodiment the gold-plated contacts 16 and 16' on the daughter board assembly 12 and the gold-plated contacts 18 on the mother board 14 are continuous from top to bottom and thus only half as many contact points are provided, as compared with the embodiment of FIGS. 4 and 5. In the embodiment of FIGS. 6 and 7 only 210 contacts are shown although any number of contacts can be provided dependent upon the length of the printed circuit boards 20 and 22' and the required manufacturing tolerances for the fabrication of the gold-plated contacts 16, 16', and 18. For mating with the gold-plated contacts 18 of FIGS. 6 and 7, the gold-plated contacts 16 of the daughter board assembly 12 would be continuous (i.e., there would be no separation such as the separation shown in FIG. 3).

Figure 8:
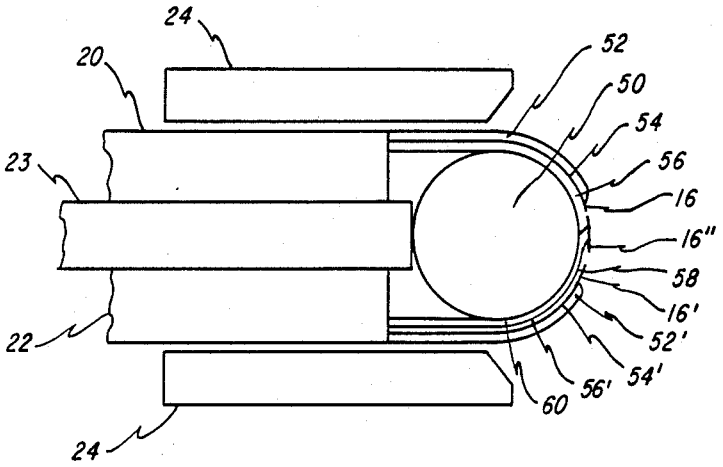
FIG. 8 is a detailed view of the daughter board contacts for a third embodiment of the present invention.

FIG. 8 illustrates another configuration for the gold-plated contacts 16 of the daughter board assembly 12. In the FIG. 8 embodiment there is a triple set of gold-plated contacts, designated by reference characters 16, 16', and 16''. The gold-plated contact 16'' is connected to components on the daughter board assembly 12 via a trace 58 located between the inner insulator layer 56 and an insulator layer 60. Thus, using the FIG. 8 embodiment with 25 mils spacing, it is possible to provide 630 zero insertion force contact points between the daughter board assembly 12 and the mother board 14. The gold-plated contacts 16 and 16' must mate with appropriately configured gold-plated contacts 18 on the mother board 14. The gold-plated contacts 18 would be similar to those illustrated in FIG. 4, except that the gold-plated contacts 18 would be split into thirds, rather than halves.

Figure 9:
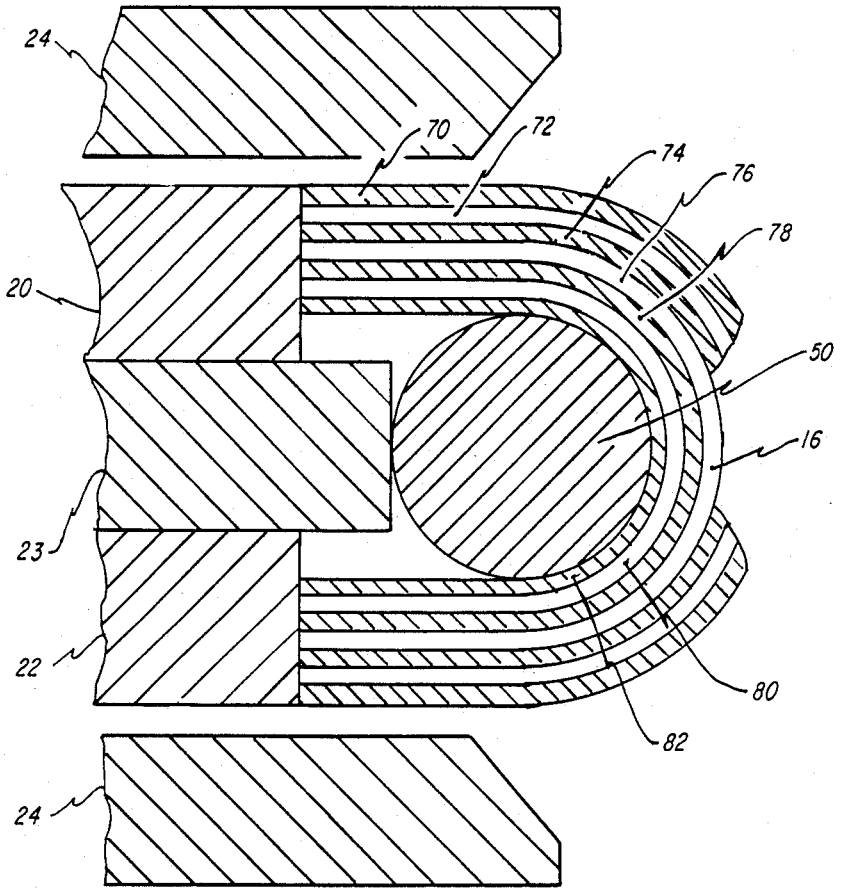
FIG. 9 is a detailed view of the daughter board contacts for a fourth embodiment of the present invention.

FIG. 9 illustrates a microstrip or stripline embodiment for the gold-plated contacts 16 of the daughter assembly board 12. Assembly of the housing 24, the rigid-flex circuit boards 20, the planar member 22, and the elastomeric rod 50 are identical to that illustrated in FIG. 3. The various elements traversing a circumferential section of the elastomeric rod 50 form a stripline conductor. It is obvious to those skilled in the art, however, that these elements could also be configured to form a microstrip conductor. Specifically, there is shown an insulating layer 70, an upper ground plane 72, an insulating layer 74, a conductive trace 76, an insulating layer 78, a lower ground plane 80 and an insulating layer 82. As can be seen, a portion of the insulating layer 70, the upper ground plane 72, and the insulating layer 74 is removed to expose the trace 76. The exposed trace is coated with gold, so as to form the gold-plated contact 16. The various layers illustrated in FIG. 9 continue the length of the daughter board assembly 12 to form a series of stripline interconnects between the daughter board assembly 12 and the mother board 14. If it is necessary to continue the stripline configuration on the mother board side of the interconnect, it would be necessary to configure the gold-plated contacts 18 in a stripline form similar to the gold-plated contacts 16 shown in FIG. 9. Thus the embodiment of FIG. 9 is suitable for use in high-speed digital or microwave applications where it is desired to provide a one or more closely spaced transmission line interconnections between the mother board and a daughter board.

Figure 10A:
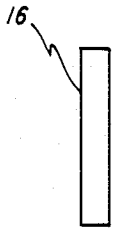
FIGS. 10A through 10D illustrate the daughter board contact patterns for various embodiments of the present invention.
Figure 10B:
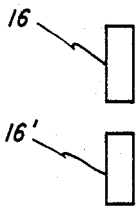
Figure 10C:
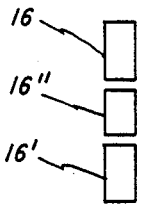
Figure 10D:
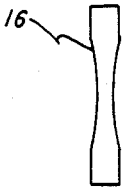

As previously discussed and as shown in FIG. 1, gold-plated contacts 16 extend the length of the daughter board assembly 12. FIGS. 10A through 10D illustrate a single gold-plated contact 16 in the various configurations discussed above. FIG. 10A shows the single continuous gold-plated contact 16 suitable for mating with the mother board configuration illustrated in FIGS. 6 and 7. FIG. 10B shows the split gold-plated contacts 16 and 16' that are shown in FIGS. 1 and 2. FIG. 10C shows the triplicate gold-plated contacts: the upper gold-plated contact 16, the lower gold-plated contact 16', and the middle gold-plated contact 16''. This embodiment is shown in side view form in FIG. 8. FIG. 10D shows a transmission line form of the gold-plated contact 16. The gold-plated contact 16 of FIG. 10D would be used in the stripline (or microstrip) configuration of FIG. 9 and could be suitably shaped to provide optimum RF coupling between the daughter board assembly 12 and the mother board 14.

Figure 11:
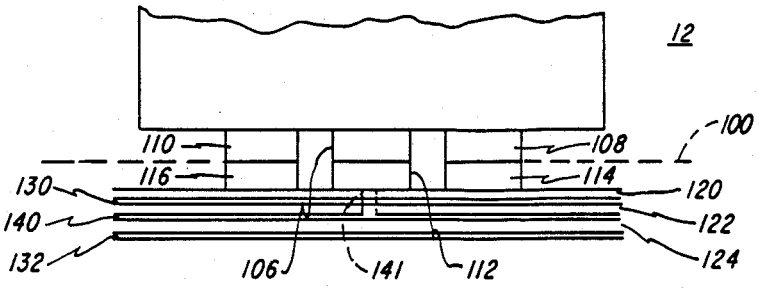
FIG. 11 shows the mother board and daughter board assembly in electrical contact for yet another embodiment of the present invention.

FIG. 11 illustrates the mating area of another mother board/daughter board interconnection scheme. The FIG. 11 embodiment is also suitable for high speed digital or RF microwave applications. The reference character 100 is the line of demarcation between the daughter board assembly 12 above the dashed line 100, and the mother board 14 below the dashed line 100. The printed circuit boards 20 and 22 of the daughter board assembly 12 each comprise a stripline conductor having conductive ground planes insulated from conductive traces as is well known in the art. These traces extend from the printed circuit boards 20 or 22 to form a signal contact 106. The ground planes also extend from the printed circuit boards 20 or 22 to form ground plane contacts 108 and 110 on each side of the signal contact 106. In this configuration the signal conductor 106 is completely surrounded by ground planes to provide exceptional signal isolation characteristics. The mother board 14 is similarly constructed with a signal contact 112 surrounded on both sides by ground plane contacts 114 and 116. Insulating layers 120, 122, and 124, ground plane layers 130 and 132, and a circuit trace layer 140 complete the stripline configuration on the mother board 14. The signal contact 112 is connected to the circuit trace layer 140 by a via 141. Thus as can be seen in this embodiment the signal contacts 106 and 112 are surrounded not only above and below but also on each side by ground planes. This embodiment would therefore provide lower losses and crosstalk, and better performance than the simpler stripline interconnect scheme shown in FIG. 9. Further, the signal contacts 106 and 112 can be suitably shaped to enhance the high-speed and RF characteristics.

Figure 12:
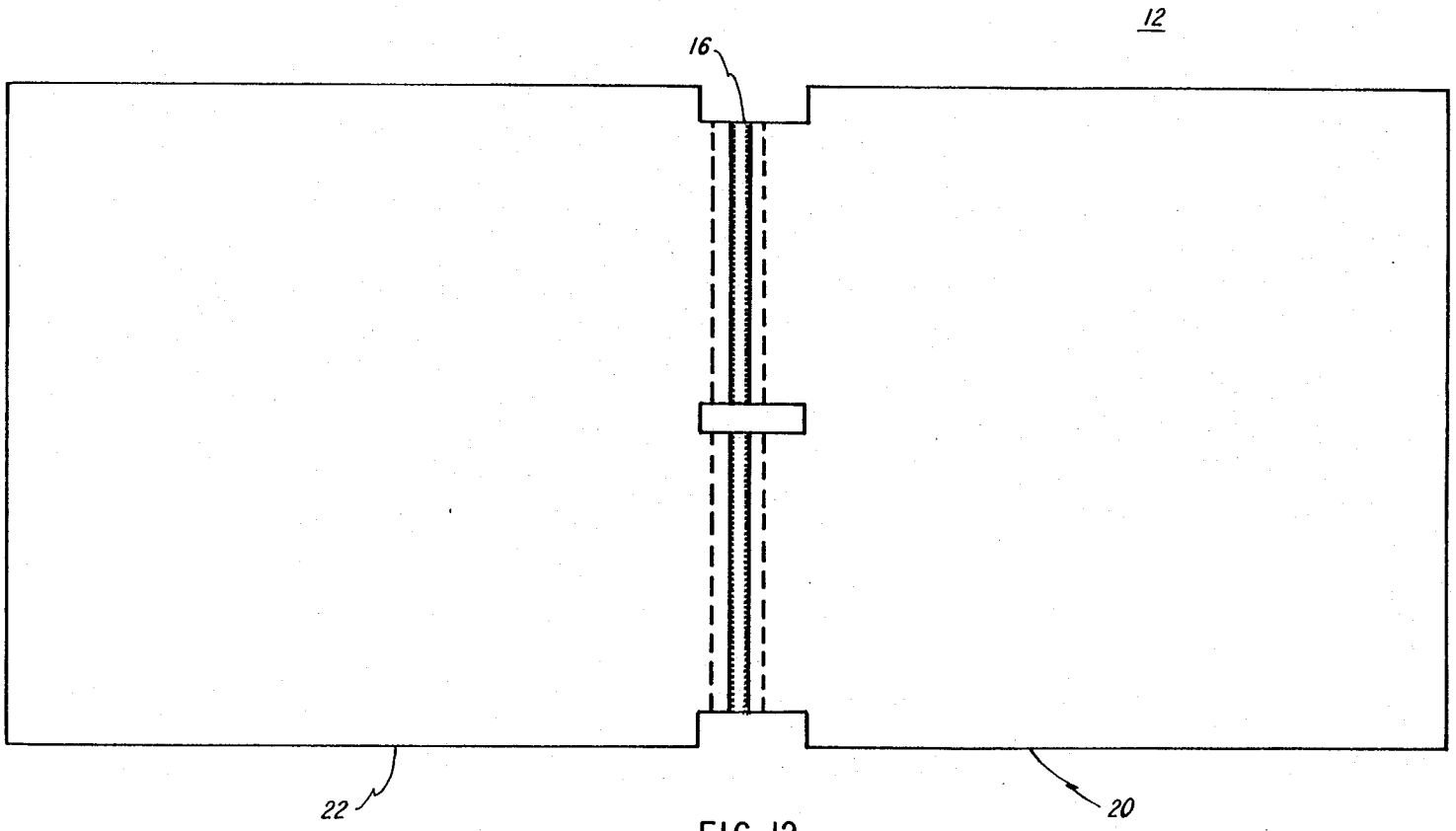
FIG. 12 illustrates the daughter board assembly in an unfolded configuration.

FIG. 12 illustrates the daughter board assembly 12 in a flat or unfolded configuration. The gold-plated contacts 16 in the upper portion thereof are continuous across the contacting area; the gold-plated contacts on the lower portion are split to form the gold-plated contacts 16 and 16' shown in FIG. 3. This configuration is useful for the assembly of parts to the daughter board assembly 12.

Figure 13:
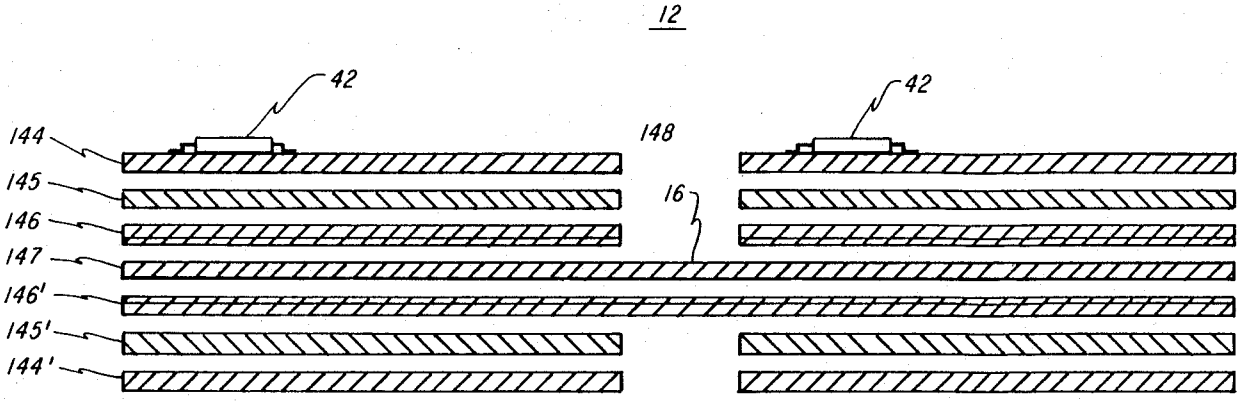
FIG. 13 is a cross-sectional view of the daughter board assembly.

FIG. 13 is an exploded cross-sectional view of the daughter board assembly 12, which illustrates the components that are stacked to form the daughter board assembly 12. The rigid top and bottom layers 144 and 144' are formed of a rigid polyimide or epoxy material. Pre-preg layers 145 and 145' are adjacent to the top and bottom layers 144 and 144'. Continuing toward the center of the daughter board assembly 12, there is a cover layer 146 beneath the pre-preg layer 145 and a cover layer 146' above the pre-preg layer 145'. The cover layers 146 and 146' include adhesive on their center facing surfaces to adhere to a flexible copper-clad polyimide layer 147. The flexible copper-clad polyimide layer 147 has circuit traces within it, which are exposed in the area indicated generally by reference character 148. Once the circuit traces are exposed, the circuit traces are gold plated to form the gold plated contacts 16. Note that with the exception of the cover layer 146' and the flexible copper-clad polyimide layer 147, each of the layers stack to form the daughter board assembly 12 are split in the area 148. The layer segments to the left and right of the area 148 form the rigid area; the daughter board assembly 12 is flexible in the area 148. After the components 42 are mounted to the daughter board assembly 12, it is flexed to bring the two rigid areas together in the shape shown in FIG. 2. The flexible copper-clad polyimide layer 147 also includes a ground plane on the bottom surface thereof. After the various layers are stacked, the assembly is subjected to an elevated temperature and pressure to join the layers together. This technique for assembling printed circuit boards is well known in the art.

Figure 14:
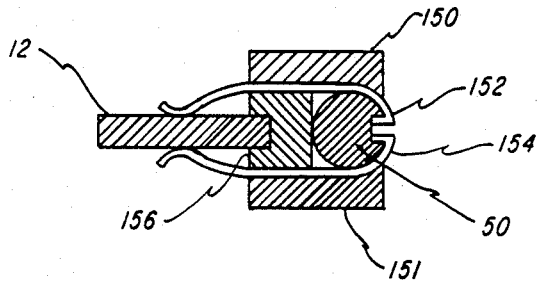
FIGS. 14–19 illustrate other embodiments of the present invention.

FIG. 14 illustrates another technique for mating the elastomeric rod 50 with the daughter board assembly 12. FIG. 14 illustrates a connector housing, having two members designated by reference characters 150 and 151. A lead frame also having two members designated by reference 152 and 154 serves as an electrical path between traces on the daughter board assembly 12 and the mother board 14 (not shown in FIG. 14). The FIG. 14 illustration also includes a lead retainer 156 for holding the lead frames 152 and 154 in proper position. The FIG. 14 assembly can be held together by screws (not shown in FIG. 14) extending vertically downward from the connector housing 150 to the lead retainer 156 or extending vertically upward from the connector housing 151 to the lead retainer 156. Although the daughter board assembly 12 is shown in FIG. 14 as a single board having contacts on both sides thereof, it is well known to one skilled in the art that the daughter board assembly 12 can be replaced by two parallel printed circuit boards having electrical traces on one or both sides.

Figure 15:
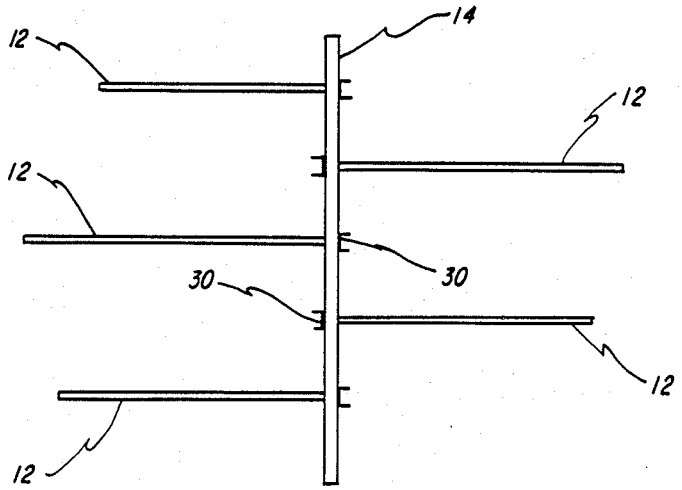

FIG. 15 illustrates yet another embodiment of the present invention wherein the mother board 14 is configured to mate with a plurality of daughter board assemblies 12. The daughter board assemblies 12 can be mounted on one or both sides of the mother board 14 as shown, using the extruded backing member 30 as shown in FIG. 2. A suitably configured mother board 14 can also act as a heat sink for transferring heat away from the daughter board assemblies 12.

Figure 16:
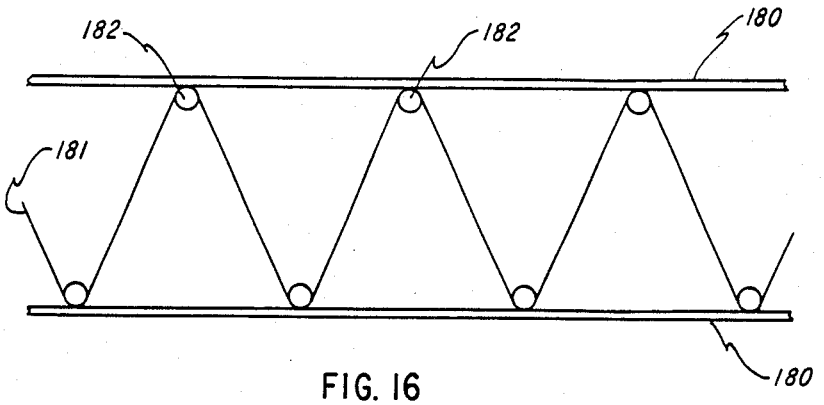

FIG. 16 illustrates yet another embodiment utilizing the inventive techniques associated with the present invention. Two printed circuit boards, designated by reference characters 180 are shown in FIG. 16 as connected by a ribbon cable 181. Rather than using the typical pin/socket interconnect scheme with the ribbon cable 181, the embodiment of FIG. 16 uses elastomeric rods 182 to urge exposed areas of the ribbon connector 181 against contacts on the printed circuit boards 180. To form these contact areas, the insulation is stripped from the ribbon cable 181 in selected areas and the exposed conductors are then gold-plated to form contacts, such as the gold-plated contacts 16 in FIG. 2. A mating contact configuration is etched onto the printed circuit boards 180 and the gold-plated contacts of the ribbon cable 181 are urged against the contacts of the printed circuit boards 180 by the elastomeric rods 182, and a support member, such as the extruded backing member 30 shown in FIG. 2.

Figure 17:
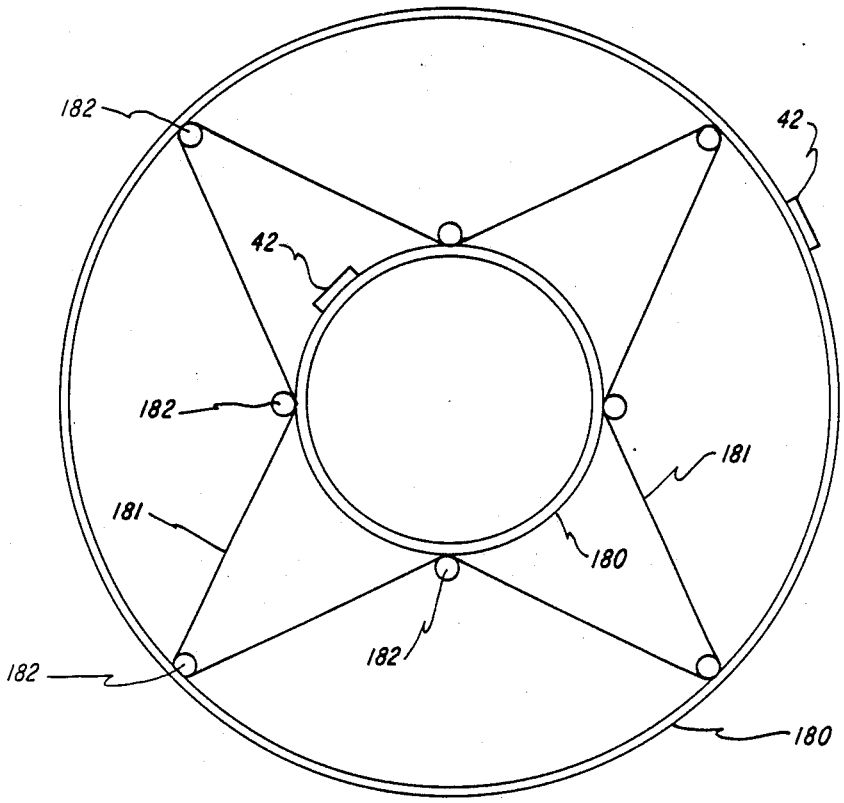

FIG. 17 shows an embodiment similar to that of FIG. 16, with the printed circuit boards 180 having a spherical or cylindrical, rather than a planar, configuration. Component mounting is illustrated by the component 42. To take maximum advantage of this configuration, high-speed signals can be routed on the inner (smaller) printed circuit board 180 while constant or slowly-changing signals (e.g., power supply voltages) can be placed on the outer (larger) printed circuit board 180.

Figure 18:
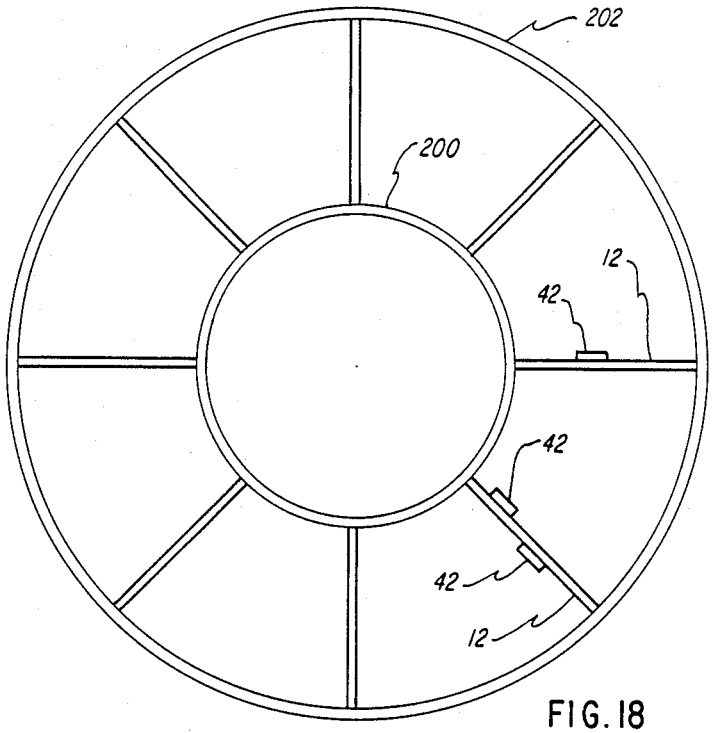

FIG. 18 illustrates another embodiment constructed according to the teachings of the present invention. The FIG. 18 embodiment includes an inner mother board 200 and an outer mother board 202 interconnected by daughter boards 12, which are constructed according to the teachings of the present invention. Components 42 can be mounted on one or both sides of the daughter boards 12, as shown. The daughter boards 12 would have the basic construction shown in FIG. 2 with the mating contacts on the inner surface of the outer mother board 202 or the outer surface of the inner mother board 200. Alternatively, the daughter boards 12 can be constructed with the elastomeric rod 50 and the gold-plated contacts 16 on two parallel edges thereof so that they can mate with matching contacts on both the inner surface of the outer mother board 202 and the outer surface of the inner mother board 200. Again, to take maximum advantage of this configuration, high speed signals can be routed on the outer mother board 202 while constant or slowly-changing signals can be routed on the inner mother board 200. The FIG. 18 embodiment is cylindrical in shape, with FIG. 18 actually being a cross-section through the cylinder. The cylindrical shape of FIG. 18 is merely exemplary, other shapes, such as square or rectangle, could also be accommodated with this embodiment.

Figure 19:
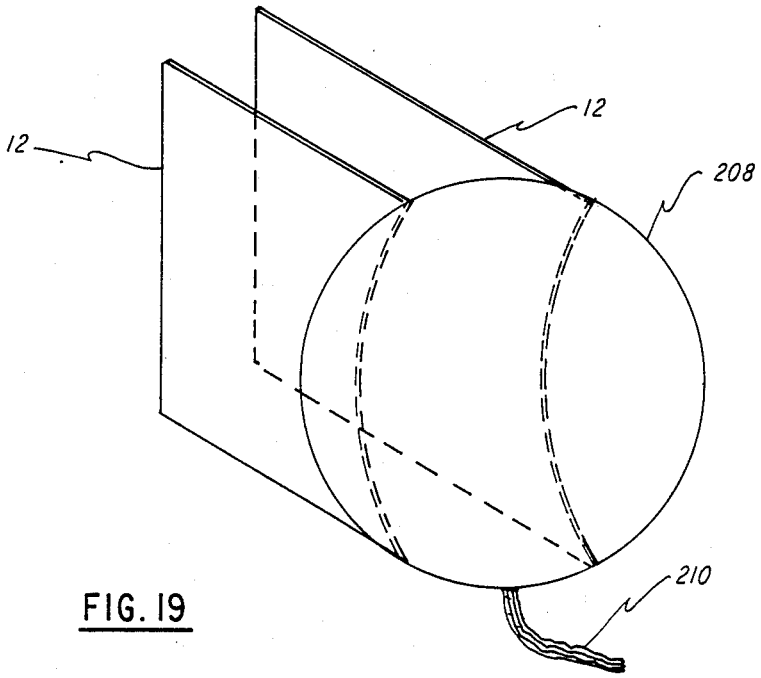

FIG. 19 illustrates another embodiment constructed according to the teachings of the present invention. In this embodiment the daughter boards 12 are constructed according to the teachings of the present invention for mating with a spherical mother board 208. The mating pattern for the daughter board assemblies 12 is etched into the outside surface of the sphere 208. The signal paths can be located on the inner or outer surface of the sphere for interconnecting the various daughter board assemblies 12. The daughter board assemblies 12 can be mounted to the sphere using the extruded backing member 30 illustrated in FIG. 2 or using any other well-known techniques for printed circuit board mounting. The sphere 208 may be separable into two halves for accessing the interior surface thereof and for carrying signals out of the sphere 208 via a cable bundle 210. Alternatively, the daughter board 12 assemblies can simply be mounted to the surface of the sphere and printed circuit traces on the exterior surface can route the signals between the daughter board assemblies 12 and also serve as a terminal point for connection of the cable bundle 210.

As can now be appreciated, the present invention is amenable to numerous embodiments in which printed circuit board traces are extended from a flexible member (e.g., a daughter board) to form contact areas for mating with a rigid surface (e.g., a mother board). The number and spacing of such contacts can be varied and the contacts can be shielded by variously configured ground planes to optimize high-speed or RF performance. The incorporation of a heat conducting member as a supporting member in various embodiments enhances the usefulness of the present invention and contributes to its many unique geometries.

Although I have shown and described several embodiments in accordance with the present invention, it is understood that the present invention is not limited to these embodiments, but is susceptible of numerous changes and modifications as known to a person skilled in the art. I therefore do not wish to be limited to the details shown and described herein, but intend to cover all such changes and modifications as are obvious to one of ordinary skill in the art.

What is claimed is:

1. A circuit interconnect system comprising:

a substrate having electrical traces thereon and being adapted for mounting electrical components thereto;

wherein said substrate includes an insulative flexible portion, wherein said flexible portion includes a plurality of first exposed conductive segments, and wherein preselected ones of said first exposed conductive segments are electrically connected to preselected ones of said electrical traces on said substrate;

wherein said substrate is foldable in the area of said flexible portion so as to place said first conductive segments at an edge of said substrate;

an insulative member having a plurality of second exposed conductive segments;

wherein said plurality of second conductive segments are adapted to contact said plurality of first conductive segments at an edge of said substrate to form said interconnect system.

2. The circuit interconnect system of claim 1 wherein the substrate includes a printed circuit board having electrical traces thereon for connecting the electrical components mounted thereon.

3. The circuit interconnect system of claim 2 wherein each one of the plurality of first conductive segments is an extension of at least one of the conductive traces on the printed circuit board.

4. The circuit interconnect system of claim 1 wherein the insulative member is a mother board and the substrate is a daughter board.

5. The circuit interconnect system of claim 1 wherein the insulative member is a substrate adapted for mounting electronic components thereon.

6. The circuit interconnect system of claim 1 wherein the flexible portion bifurcates the substrate into two sections, and wherein in the folded configuration said two sections are placed in substantially parallel alignment, and including a member located between said two sections to hold said two sections in the substantially parallel alignment.

7. The circuit interconnect system of claim 1 wherein the substrate is folded around a cylindrical elastomeric rod in the area of the flexible portion and, wherein the folded flexible portion is in contact with said elastomeric rod for urging the plurality of second conductive segments against the plurality of first conductive segments.

8. The circuit interconnect system of claim 1 wherein the flexible portion is formed of a rigid-flex material.

9. The circuit interconnect system of claim 1 wherein the plurality of first exposed conductive segments have a spacing of at least 25 mils.

10. The circuit interconnect system of claim 1 wherein the plurality of first exposed conductive traces have a minimum spacing within lithographic tolerances.

11. The circuit interconnect system of claim 1 wherein in the folded configuration each of the plurality of first conductive segments is continuous around at least a portion of the circumference of the arc formed in the flexible portion.

12. The circuit interconnect system of claim 11 wherein each of the plurality of first conductive segments is divided into at least two separate conductive traces around the circumference of the arc.

13. The circuit interconnect system of claim 1 wherein the flexible portion includes a foldable flat cable having a plurality of parallel spaced-apart conductors between an inner and outer insulative layer, and wherein a portion of said outer insulative layer is removed to form the plurality of first conductive segments.

14. The circuit interconnect system of claim 1 including a housing enclosing the substrate in the folded configuration, said housing including attachment means for detachably mounting the folded substrate to the insulative member.

15. The circuit interconnect system of claim 14 wherein the housing includes at least two alignment pins and wherein the insulative member includes at least two alignment holes, and wherein engagement of each alignment pin in an alignment hole ensures proper alignment between the first and the second conductive segments.

16. A printed circuit board and connector in combination comprising:

a pair of insulating units;

a flexible insulating strip connecting said insulating units;

a plurality of conductive strips formed on each one of said insulating units and extending continuously onto said flexible insulating strip;

wherein a portion of said flexible insulating strip is in a general U-shape and wherein said plurality of conductive strips are exposed in the area of said general U-shape, resilient means positioned within the U-shaped bend of said flexible insulating strip so as to contact the U-shaped portion;

a third insulating unit having a plurality of conductive strips formed thereon in a pattern to match the pattern of the plurality of conductive strips on said flexible insulating strip;

means for mounting said pair of insulating units to said third insulating unit so that said plurality of conductive strips on said flexible insulating strip contact said plurality of conductive strips on said third insulating unit.

17. A transmission line circuit interconnect system comprising;

at least two microstrip substrates each having a ground plane and electrical traces thereon and being adapted for mounting electronic components thereon;

a planar microstrip member having a first plurality of exposed traces;

flexible means connecting said at least two microstrip substrates, and including a microstrip ground plane and a second plurality of exposed traces, wherein each one of said second plurality of exposed traces is electrically connected to a predetermined one of the traces on at least one of said two microstrip substrates;

an elastomeric rod located behind and in contact with said flexible means;

and wherein said first plurality of exposed traces is placed in electrical contact with said second plurality of exposed traces and wherein said elastomeric rod urges said first plurality of exposed traces against said second plurality of exposed traces to form said transmission line circuit interconnect system.

18. The microstrip circuit interconnect system of claim 17 wherein the second plurality exposed conductive traces of the flexible means are shaped to provide predetermined transmission line characteristics.

19. A transmission line circuit interconnect system comprising;

at least two stripline substrates each one having electrical traces thereon and being adapted for mounting electronic components thereon;

a planar stripline member having a first plurality of exposed traces;

flexible means connecting said at least two stripline substrates and including a stripline ground plane and a second plurality of exposed traces, wherein each one of said second plurality of exposed traces is electrically connected to a predetermined one of the traces on at least one of said two stripline substrates;

an elastomeric rod located behind and in contact with said flexible means;

wherein said first plurality of exposed traces is placed in electrical contact with said second plurality of exposed traces and wherein said elastomeric rod urges said first plurality of exposed traces against said second plurality of exposed traces to form said transmission line interconnect system.

20. The stripline circuit interconnect system of claim 19 wherein the second plurality of conductive traces of the flexible means are shaped to provide predetermined transmission line characteristics.

21. The stripline circuit interconnect system of claim 19 wherein a predetermined number of the plurality of the first and the second exposed conductive traces are signal traces, and a predetermined plurality of the first and the second exposed conductive traces are ground traces, such that said ground traces are proximate said signal traces.

22. A circuit interconnect system comprising:

a first substrate having electrical traces thereon;

wherein said first substrate includes a first flexible portion at one edge thereof, and a second flexible portion at a second edge thereof, and wherein at least one of said electrical traces passes through and is exposed in the area of said first and said second flexible portions to form at least one conductive contact area on said first and said second flexible portions;

first and second resilient means positioned within said first and said second flexible portions respectively;

a second and a third substrate having electrical traces thereon, wherein said second and said third substrates each include a conductive contact area;

wherein said at least one conductive contact area of said first flexible portion is urged against said conductive contact area of said second substrate by said first resilient means and wherein said at least one conductive contact area of said second flexible portion is urged against said conductive contact area of said third substrate by said second resilient means.

23. The circuit interconnect system of claim 22 wherein the first, the second, and the third substrates are adapted for mounting electrical components thereto.

24. The circuit interconnect system of claim 22 wherein the second and the third substrates are parallel planar surfaces.

25. The circuit interconnect system of claim 22 wherein the second and the third substrates are closed surfaces wherein the second substrate is disposed within the interior of the third substrate.

26. The circuit interconnect system of claim 22 wherein the second and the third substrates are cylindrically shaped with concentric axes of symmetry.

27. An electrical interconnect circuit comprising:

a substrate being adapted for receiving electrical components to be mounted thereon and having electrical traces for making electrical contact thereto;

flexible means attached to an edge of said substrate, said flexible means including, along an outside surface thereof, a plurality of first conductive segments, wherein preselected ones of said first conductive segments are electrically connected to preselected ones of said electrical traces; and resilient means located between an edge of said substrate and said flexible means;

an insulative member having a portion formed with a shape conforming to said edge of said substrate and having a plurality of second conductive segments thereon, so that said selected ones of said plurality of second conductive segments are adapted to come into engagement and make electrical contact with selective ones of said plurality of first conductive segments when said substrate and said insulative member are urged into engagement, wherein said resilient means exerts a force against said flexible means to urge said first conductive segments into contact with said second conductive segments.

* * * * *